United States Patent [19]

Teague, Jr.

[11] 4,370,766

[45] Feb. 1, 1983

[54] PANEL BED AND COUNTERBALANCING MECHANISM FOR PANEL BED

[75] Inventor: W. Dorwin Teague, Jr., Nyack, N.Y.

[73] Assignee: Murphy Door Bed Company, Inc., New York, N.Y.

[21] Appl. No.: 213,054

[22] Filed: Dec. 4, 1980

[51] Int. Cl.[3] ..... A47C 19/06

[52] U.S. Cl. ..... 5/133; 5/164 R

[58] Field of Search ..... 5/133, 136, 137, 134, 5/141, 142, 164 R, 164 B, 164 C, 164 D, 164 E, 56

[56] References Cited

U.S. PATENT DOCUMENTS

| | | | |
|---|---|---|---|
| B 594,871 | 3/1976 | Bue et al. | 5/164 R |
| 1,043,477 | 11/1912 | Smith | 5/164 R |
| 1,520,256 | 12/1924 | Moon | 5/133 X |
| 1,570,579 | 1/1926 | Smith et al. | 5/164 R |
| 4,234,979 | 11/1980 | Bergerud | 5/164 R X |

*Primary Examiner*—Roy D. Frazier
*Assistant Examiner*—Michael F. Trettel
*Attorney, Agent, or Firm*—Pasquale A. Razzano

[57] ABSTRACT

A bed which is movable between a horizontal open position and a vertical closed position wherein a counterbalancing mechanism comprising two levers and gas springs are placed at the foot of the bed in order to provide a lifting moment for help in closing the bed and a gravitational restraint when opening the bed.

11 Claims, 4 Drawing Figures

PANEL BED AND COUNTERBALANCING MECHANISM FOR PANEL BED

This invention relates to recess or cabinet beds of the type where a bed is mounted at its head end upon a counterbalancing mechanism which supports the bed as it swings between its horizontal or "open position" for use and its vertical or "closed position" for storage. The invention relates particularly to improved counterbalancing mechanisms.

An object of this invention is to provide improved counterbalancing mechanisms for panel beds. A further object is to provide such mechanisms which are adaptable for use throughout wide ranges in the conditions of installation and in the weight of the bed. Counterbalancing mechanisms of this type have been provided which are mounted upon and anchored to the floor. In one type, the counterbalancing forces have been provided by various spring systems, some of which utilize a plurality of coil springs attached to extensions of the side rails of the bed or to other lever systems.

When the bed is being moved between its open and closed positions, it should not be necessary for the operator to exert any substantial force at any time. Therefore, the counterbalancing forces should vary automatically from a maximum value when the bed is leaving its open position to a minimum value when the bed approaches its closed position. The weight of the bed can vary depending upon the particular mattress which is installed and upon the bedding. Friction is an important factor in that it can add to the "load" which the counterbalancing mechanism must exert during the lifting of the bed. It is a further object of the present invention to provide an improved counterbalance mechanism in combination with a bed, whereby the bed has two stable rest positions, one when open and the other when closed, and whereby the bed is moved between those positions by exerting very little force more than the forces required to overcome friction and the minor factor of momentum. A further object is to provide for the above with constructions which are sturdy, dependable and simple. These and other objects will be in part obvious and in part pointed out below.

In beds of this type, the pivot axis is positioned adjacent the front of the cabinet so that the center of gravity of the bed passes over the pivot axis as the bed swings into the cabinet to the fully closed position. Therefore, the action of gravity tends to hold the bed in its fully closed position. However, the coil springs also exert forces holding the bed in the fully closed position, and that is objectionable because it increases the "lifting" force required to move the bed from its fully closed position. That is, a force must be exerted which is sufficient to overcome the effect of the weight of the bed as it is moved to the position where its center of gravity is over the pivot axis, but the lifting force or moment must be sufficiently greater than that so as to also overcome the moment or force required to expand the springs. The present invention provides a varying counterbalancing force having a value during the entire movement of the bed which is substantially equal to the required counterbalancing force. The present invention overcomes the difficulty referred to above wherein the counterbalancing springs increase the "load" involved in the initial movement of the bed from its fully closed position.

In accordance with the present invention, the action of the springs is reversed whenever the center of gravity of the bed passes over the pivot axis. Therefore, the springs provide the lifting force or moment to move the bed up to the position where its center of gravity passes over the pivot axis, but when the bed continues to move toward the fully closed position, the springs reverse their action and act against that continued movement. Therefore, the bed moves to that fully closed position against that spring action and the springs are placed under compression. The springs then expand and aid in moving the bed from its fully closed position to the position where its center of gravity is above its axis of movement.

Referring to the drawings.

Figures 1, 2:
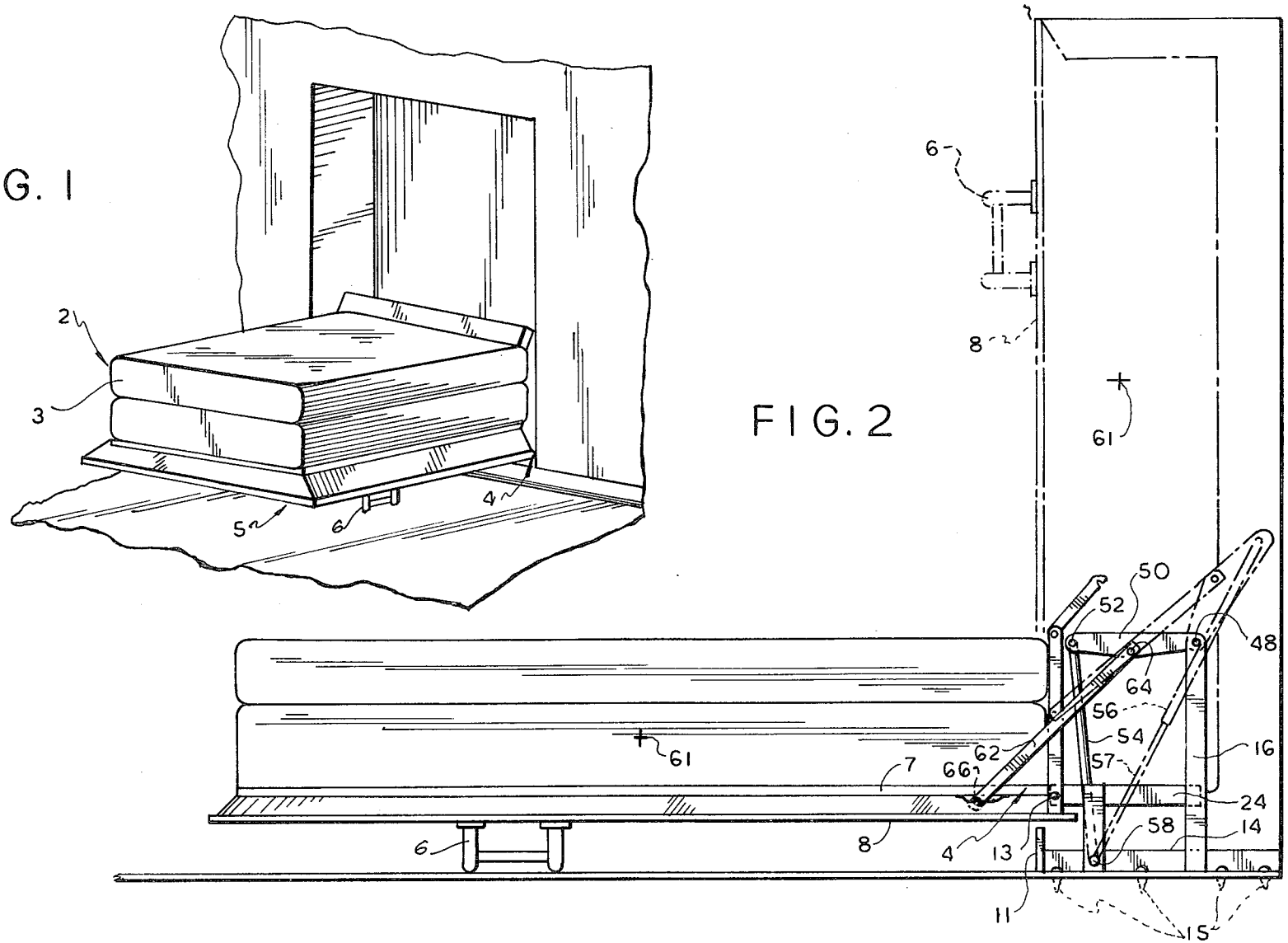
FIG. 1 is a somewhat simplified perspective view of one embodiment of the invention.
FIG. 2 is a side elevation of the bed of FIG. 1 showing the counterbalancing mechanism somewhat schematically.
Figure 3:
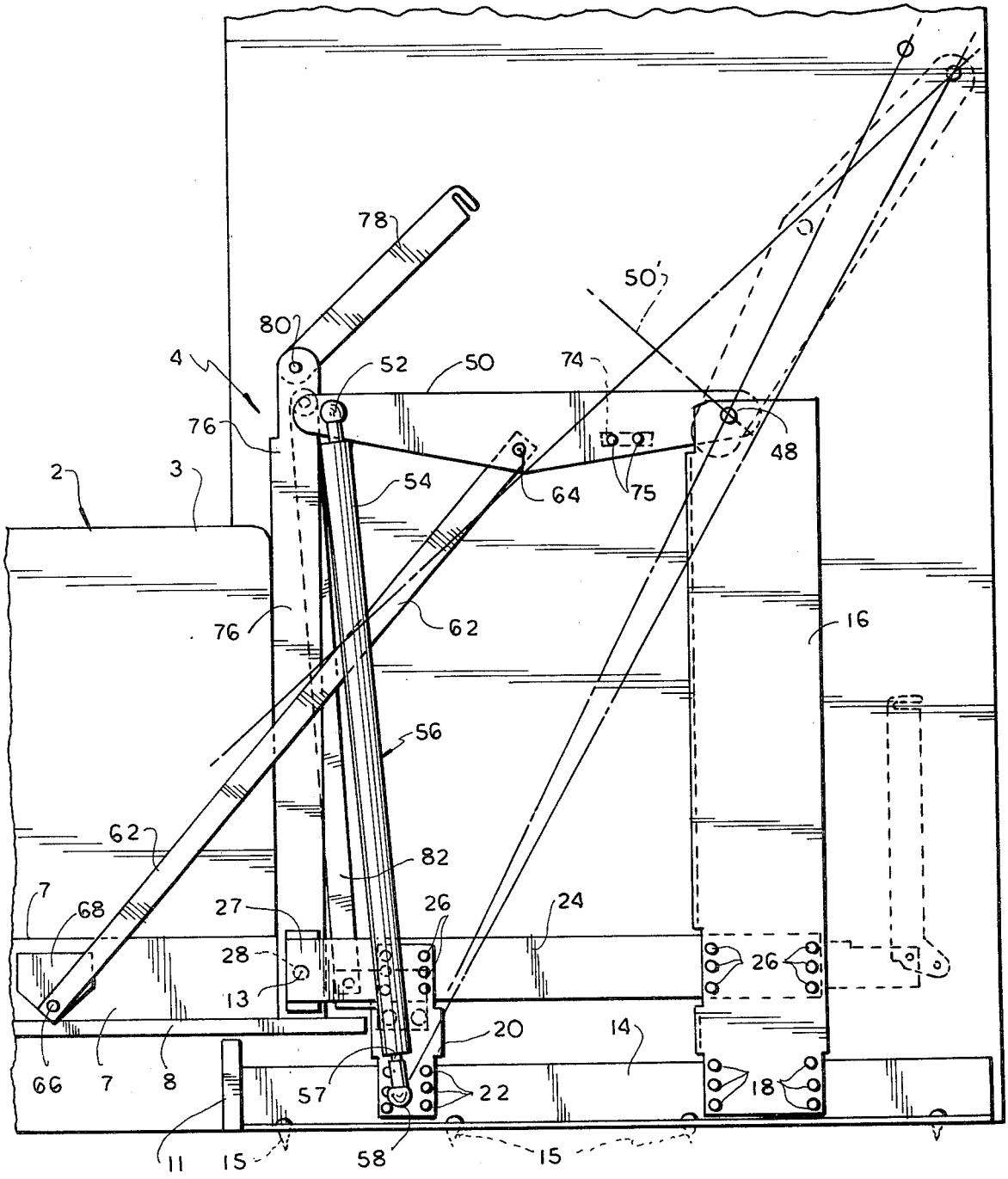
Figure 4:
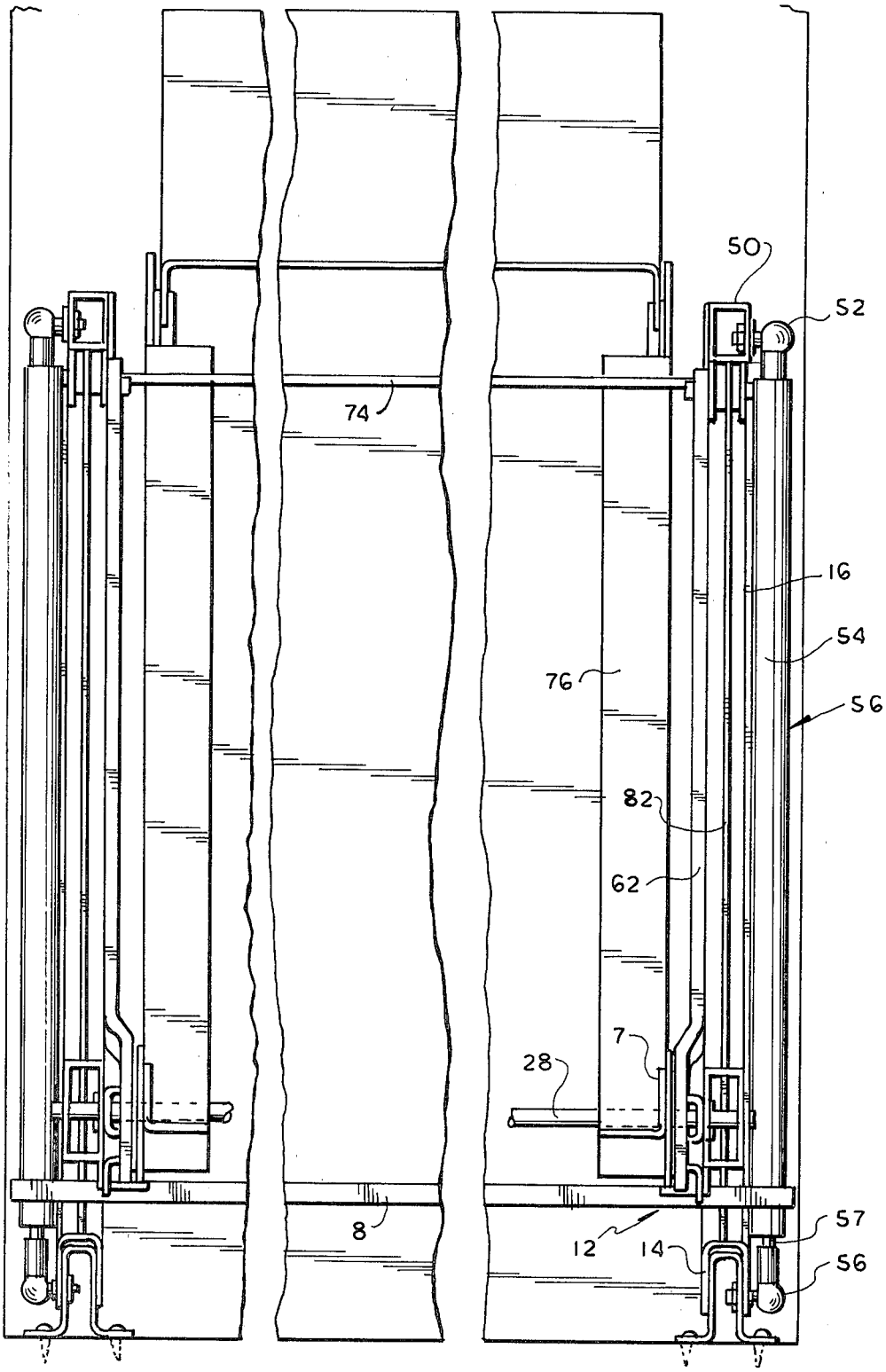

FIG. 3 is a view similar to the lower right-hand portion of FIG. 2, but on a larger scale and showing the construction more clearly; and, FIG. 4 is a vertical section of the counterbalancing mechanism of FIGS. 1 to 3 showing the two operating or support units which are at the sides of the head of the bed, and with the bed and the transverse bar which interconnects the support units being foreshortened. Certain components are also shown in broken lines in FIG. 4.

Referring to FIGS. 1 and 2 of the drawings, a bed 2 is shown in its horizontal open position for use with the bed being supported at the right by a counterbalancing mechanism 4 and at the left by a pair of loop handles 6 (only one of which is shown) which function as legs and rest on the floor. The mattress 3 and its support are supported upon a frame 5 which has side rails 7 and a panel 8 which forms the bottom of the bed frame. A cabinet 9 is mounted in the side wall of the room and provides the space for the bed when it is in its closed position, and panel 8 is then in alignment with the wall surfaces above and below it, and forms a continuous portion of the side wall of the room. Bed 2 is mounted to swing 90° about its pivot axis 13 between its open position shown in full lines in FIG. 2 and its closed position in which certain of the components are shown in broken lines.

Counterbalancing mechanism 4 is formed by two counterbalancing units 10 and 12 (see FIG. 4) which are mounted upon the floor within cabinet 9 and are spaced from each other so that bed 2 moves between them when the bed swings into the cabinet. Unit 12 will be described in detail, and unit 10 is a mirror image of unit 12. Unit 12 (see also FIG. 3) has a rigid frame which rests upon the floor and is attached thereto by screws 15. The rigid frame and the movable components of the counterbalancing unit are shown in full lines in FIG. 2 positioned as they are when the bed is open, the movable components of the unit are also shown in broken lines positioned as they are when the bed is closed.

The rigid frame of unit 12 (FIG. 3) is formed by: a horizontal base member 14 which extends along and is attached to the floor by a plurality of screws 15; a rear vertical member 16 which is mounted upon and attached to member 14 by rivets 18; a front vertical member 20 which is also attached to base member 14 by rivets 22, and which is parallel to member 16; and, a longitudinal member 24 which is positioned above and parallel to base 14, and is attached to members 16 and 20 by rivets 26. Member 24 has a forward extension 27 which has a journal bore in which the end of a pivot shaft 28 (FIG. 4) is positioned. The other end of shaft 28 is positioned in an identical bore of counterbalancing unit 10. Shaft 28 also extends through bores in the side rail 7 so that the head of the bed is supported upon pivot axis 13 through shaft 28 by the rigid frames of units 10 and 12.

Pivoted to the top of member 16 (see FIG. 3) by a pivot pin 48 is a lever 50 which is in substantially the horizontal position shown when the bed is in the open position. The forward or free end of lever 50 is attached by a pivot bolt 52 to one end of the cylinder 54 of a gas spring 56, and at the other end of the gas spring has its piston 57 connected by a pivot bolt 58 to members 14 and 20 of the frame. A link 62 is attached to the central portion of lever 50 by a pivot pin 64, and the lower end of the link is attached by a pivot pin 66 to the adjacent siderail 7 of the bed frame. A wear plate 68 is positioned between the end of link 62 and rail 7.

Gas spring 56 is of known construction, and is formed by a cylinder 54 which is closed at one end, and a piston or plunger 57 projects from the other end of the cylinder through an opening having a fluid-type seal around the plunger. Cylinder 54 is charged with compressed gas at a predetermined pressure, and the compressed gas exerts a force upon the end of the plunger urging it longitudinally from the cylinder. Therefore, the gas spring is fully compressed when the plunger has been moved to the position shown in FIG. 3, and it exerts substantial force urging the plunger longitudinally out of the cylinder. The force exerted by the gas spring varies by about 30 percent throughout the entire movement between the fully compressed and fully expanded positions. A piston-type restrictor (not shown) is mounted upon the end of plunger 57 within cylinder 54 and the restrictor has an outside diameter which snugly fits the inside diameter of the cylinder. Hence, the restrictor divides the cylinder into two chambers, and there is an orifice through the restrictor which provides the only interconnection between the chambers. Therefore, movement of the restrictor longitudinally of the cylinder produces an increase in the gas pressure in the chamber at the end of the cylinder toward which the restrictor moves and a decrease in the other chamber. The difference in pressure in the chambers causes a resultant flow of gas through the orifice, and that exerts control upon the rate at which the plunger moves when subjected to a predetermined force. While the pressure of the gas in the gas spring acts to force the plunger from the cylinder so as to increase the overall length of the spring, the speed of movement of the plunger is always limited by the rate at which gas flows through the orifice from one chamber to the other. The rate of flow, and therefore the rate at which the plunger will move, increases when there is an increase in the force tending to move the plunger to or from the cylinder, but the rate of movement is relatively uniform for any specific value of that force. It is thus seen that the gas springs of units 10 and 12 act together to exert equal lifting forces in somewhat the manner of conventional compression springs, the force exerted by each of the springs increasing as the spring is compressed. However, the rate of movement of the bed is limited by the rate at which the gas passes through the orifices in the gas springs.

When the bed is moved from its open position to a balanced position wherein its center of gravity 61 is directly over its pivot axis, and upon further movement the gas springs continue to act as compression springs but their action is reversed. Hence, the springs act against the force of gravity which moves the bed to its fully closed position.

During the movement of the bed from its open position to the position wherein its center of gravity 61 is over its pivot axis 13, each lever 50 is swung to a position wherein its pivot 52 is in alignment with the lever pivot 48 and the gas spring pivot 58 so that the gas springs are nearly fully extended and they are exerting no moment of force. However, as bed 2 continues to swing clockwise around its pivot axis to its fully closed position, each of levers 50 continues to swing cockwise around its pivot axis 48 and pivot 52 moves along an arcuate path beyond its position in alignment with pivots 58 and 48. That further swinging movement of lever 50 causes the gas springs to be subjected to compression and they act against and cushion the action of gravity as the bed moves to its fully closed or rest position. In this embodiment, pivots 58, 48 and 52 are in alignment when lever has moved through an angle of 116°, and the lever has moved 124° when the bed is fully closed.

A crossbar 74 (FIGS. 3 and 4) extends between levers 50 of units 10 and 12 with its ends attached firmly to the levers by stud bolts 75 which extend through the levers. Crossbar 74 provides stability between the levers and uniformity of action. The bed frame includes a headboard 76 (FIG. 3) which holds the mattress assembly in the proper position as the bed moves between its open and closed positions. A slanting upper headboard 78 is pivoted to the top of headboard 76 by pivot 80. A link 82 is mounted at its lower end by a pivot 84 to member 24 and at its upper end to an ear on the upper headboard by a pivot 86. When the bed swings to the closed position, link 82 swings to headboard 78 around pivot 80 to the broken line position of FIG. 3.

The force exerted by each gas spring 56 acts through the lever arm length between pivots 48 and 52 of lever 50. That length of lever arm is such that the gas spring moves between nearly fully extended and nearly fully compressed positions so as to take advantage of the full stroke of the gas spring. As bed 2 swings from its open position, pivot 52 moves upwardly along an arcuate path around axis 48 so that the pivot also moves to the right. That reduces the angle between line of force of the gas spring and lever 50 and produces a reduction in the lever arm through which the force acts. The turning or lifting moment produced by the gas spring is therefore reduced until there is no lifting moment when pivot 52 reaches the position where it is in alignment with pivots 58 and 48. Initially, link 52 is at an angle of the order of 40° from the lever arm formed by the portion of lever 50 between the link pivot 64 and the lever pivot 48. Hence, the effective lever arm between the lever 50' and link 62 is the length of the radius line 50' extending from pivot 48 which intersects at right angles to the extension of the line between the pivots 64 and 66 of the link. The length of that lever arm also varies as pivot 64 moves upwardly.

Link 62 is at an angle of the order of 45° with respect to the lever arm formed by the portion of the bed rail 7 between pivots 28 and 66. The lifting moments produced when the bed starts its movement from its fully open position is therefore transmitted from the gas springs through levers 50 and thence through links 62 to the bed rails. As the bed moves upwardly, side rails 7 move together, and the angles between the side rails and the levers are substantially the same during a portion of the swinging movement of the bed, but levers then move faster than the bed. When the bed has moved to the position where its center of gravity 61 is directly over pivot 13, pivot 52 has moved into alignment with pivots 58 and 48. As the center of gravity swings to the right from that position, pivot 52 moves onto the position 52' and the bed is then in its fully closed position.

The combination of the leverage relationships discussed above and the unique characteristics of the gas springs results in a lifting moment about pivot axis 13 which is at or near its maximum value when the bed is in its fully opened position. The lifting moment varies somewhat but remains within a range which effectively counterbalances the action of gravity at all times taking into account the effects of friction. As the bed reaches the position in which its center of gravity is directly above pivot axis 13, pivots 52, 48 and 64 are in alignment so that gas springs 56 are expanded to their maximum length and the gas springs produce no lifting moment. As the bed continues to move toward its fully closed position, the gas springs are partially compressed and they "cushion" the bed as it approaches its fully closed position. When it is desirable to open or close the bed, the air springs exert lifting moments which have a total value of the order of the moment produced by the weight of the bed and friction. Therefore, the force required to move the bed from its fully open position is substantially only that required to overcome friction with there being minor requirements to overcome momentum.

The counterbalancing units 10 and 12 and crossbar 74 are the operating units of a counterbalancing system which (see FIG. 4) interconnects links 50, and in this embodiment also includes the floor of the cabinet. However, when desirable, the rigid frames of units 10 and 12 are interconnected at the floor level and at the rear by other means such as rigid sheet material or longitudinal members which do not interfere with the operation of the counterbalancing unit.

In this embodiment, when the bed is in its open position, the center of gravity 61 of the bed is 6 inches above pivot axis 13 and 40 inches horizontally of the bed from the axis. Assuming a so-called queen size bed with a weight including spring, mattress, bedding, frame, and finish panel all, of 244 lbs. whose center of gravity 61 is located 40 inches from pivot 13 and 6 inches above the pivot, with the bed in the fully open position, the moments to be counterbalanced by two gas springs are: 9760, 5734 and −1464 inch lbs. or 4880, 2867 and −732 inch lbs. per spring in the fully-open, half-open and fully-closed positions, respectively. Thus, neglecting friction, the effort that the user must exert will be the difference between these moments and the counterbalancing moments which, based on the geometry of the counterbalance mechanism as shown in the drawing, and two commercial gas springs of 222 lbs. load in the extended position, are −4880, −2372 and +531 in the open, half-open and closed positions, respectively. Thus user effort will be (+4880−4880) or zero in the fully open position, (+2867−2372) or 495 inch lbs. in the half-open position and (−732+531) or 201 inch lbs. in the fully-closed position. Based on radii of 84 inches in the open position (the operator grasping the handles first lifts the bed from the extreme "foot" end), and 60 inches in the half-open and closed positions. Hence, the force the operator must exert to close the bed in the open and half-open positions is zero and (495/60)=8.2 lbs., respectively. To open the bed from the fully-closed position, the operator must pull with a force of (201/60)=3.3 lbs.

As pointed out above, when bed 2 is in the fully closed position, the counterbalancing mechanism is helping the operator to open the bed, while in the half-open and fully-open positions it is acting in the closing direction. In previous mechanisms the torque in the fully-closed position is acting to hold the bed closed, thus making the initial opening difficult. The effort required to open or close the bed throughout the action is much less than with previous counterbalancing mechanisms. The above figures take into account the fact that the force exerted by the spring increases somewhat as it is compressed.

It should be noted that the moment tending to pry the frames of units 10 and 12 off the floor is considerable, so that it is important to attach the frame members of the units firmly to the floor.

The invention contemplates that modifications can be made in the construction and operation without departing from the invention as set out in the claims.

I claim:

1. A bed which is moved between a horizontal open position for use and a vertical closed position for storage, and a counterbalancing mechanism which includes first pivot means which supports one end of said bed and provides first pivot with a first pivot axis about which said bed is swung in moving between said open and closed positions with said bed having a rigid frame and means which cooperates to provide said first pivot means, said counterbalancing mechanism comprising a rigid fixed structure and two lever and gas-spring assemblies mounted thereon, said rigid fixed structure comprising two support units spaced from each other substantially the width of said bed and positioned whereby said one end of said bed is between said support units when said bed is in said closed position, said rigid fixed structure also including means rigidly attaching said support units stationary in said spaced relationship, said lever and gas-spring assemblies being mounted respectively upon said support units and each including a lever and second pivot means therefor which provides a second pivot axis parallel to said first pivot axis and spaced horizontal and vertical distances from said first pivot axis with said horizontal distance being substantially equal to the length of said lever, each of said lever and gas-spring assemblies also including a link interconnecting the central portion of said lever to said frame with the connection to said frame being adjacent the bottom of said bed and spaced horizontally away from its support unit when said bed is in said open position and being positioned substantially above said first pivot when said bed is in said closed position, and a gas spring which is mounted to exert a force on said lever which is transmitted through said link to provide a lifting moment on said bed about said first axis, the relationship between said gas spring and said lever and said link and the pivot axes thereof being such that said lifting moment varying in a pattern which is similar to the pattern of the moment of the force of gravity about said first pivot axis as said bed is moved between said open and closed positions.

2. The construction as described in claim 1 wherein each of said support units comprises: a frame structure which provides support for said first pivot means and said second pivot means, and wherein the center of gravity of said bed passes over said first pivot as it moves toward said closed position, each of said gas springs having a cylinder and a piston with the piston being mounted to move longitudinally to and from its cylinder and being urged from said cylinder by gas pressure within said cylinder and with the gas spring being pivotally mounted at one end by third pivot means attached to the end of said piston and at its other end by fourth pivot means attached to said cylinder at the opposite end of said gas spring, said gas spring being mounted on said pivot means in a substantially vertical position with one end being attached to said frame means and the other being attached to said lever at the end thereof opposite said second pivot means thereby providing a third pivot axis and a fourth pivot axis, respectively at the opposite ends of said gas spring, said gas spring being mounted with respect to said lever such that it swings through a predetermined arc whereby the line between said third and fourth pivots passes said second pivot substantially when said center of gravity of said bed passes over said first pivot.

3. The construction as described in claim 2 wherein said lever is positioned substantially horizontally and said fourth pivot axis is above and substantially in vertical alignment with the third pivot axis when said bed is in said open position.

4. A bed which is moved between a horizontal open position for use and a vertical closed position for storage, and a counterbalancing mechanism which includes first pivot means which supports one end of said bed and provides a first pivot with a first pivot axis about which said bed is swung and moving between said open and closed positions, said bed having a frame construction which cooperates with said pivot means to provide said first pivot axis, said counterbalancing mechanism including two groups of fixed pivot means which are so positioned as to be adjacent the opposite sides of said bed when said bed is in said closed position, each of said groups of pivot means including means cooperating to form said first pivot means for said first pivot axis and means cooperating to provide second and third pivot means forming respective second and third pivot axes, a lever having means at one end cooperating to form said second pivot means and pivot means at its other end which cooperates to form a fourth pivot means forming a fourth pivot axis, the respectively numbered pivots of said groups of pivot means being in horizontal alignment, two gas springs positioned respectively at said two groups of pivot means and each having pivot means cooperating to produce said third and fourth pivot means for said third and fourth pivot axes with said gas spring being expansible between said third and fourth axes, two link means associated respectively with said levers and having means cooperating therewith to form a fifth pivot means forming a fifth pivot axis, said bed having means at each of its opposite sides which cooperates with said second end of the respective link to provide sixth pivot means interconnecting the link to said bed at a sixth pivot axis, whereby the expansion of said gas springs acts through said levers and said links to produce lifting moments which substantially counterbalance the weight of said bed when swinging about said first axis.

5. The construction as described in claim 4 wherein each of said gas springs is positioned with said fourth axis substantially above said third axis, whereby the said lifting moment produced by the action of each gas spring is at a high value when said bed is in its fully open position and the cooperative action between each lever and its link and gas spring varies during the swinging movement of said bed between its open and closed positions in accordance with a pattern which is substantially the same pattern as the moment produced by the action of gravity with respect to said bed.

6. The construction as described in claim 5 wherein said levers are substantially horizontal when said bed is in said open position with said second pivot means is at the end of the lever remote from said bed and is above the level of the center of gravity of said bed, and wherein each of said links extends at a substantial angle to the horizontal with said fifth pivot axis being substantially above said sixth pivot axis.

7. The construction as described in claim 6 wherein each of said links is positioned at an angle of the order of 40° to 55° from the horizontal when said bed is in its fully opened position.

8. The construction as described in any of claims 1, 2 and 4 to 7 wherein the complete angular movement of said bed is substantially 90°, and wherein there is simultaneous swinging movement of said levers through an angle whereby said fourth pivot axis is in alignment with said second and third pivot axes when the center of gravity of said bed is substantially directly above said first pivot axis and whereby the continued swinging movement of said bed to said closed position partially compresses said gas springs.

9. The construction as described in any of claims 1, 2 and 4 to 7 wherein said bed swings to said closed position within an enclosure with said bed having means forming a closure for the front of said space, and wherein the construction includes a support member extending upwardly along each side wall and the rear wall of said space, and wherein said first and second pivot axes are adjacent the front of said enclosure.

10. In combination, a bed which is adapted to move between a horizontal position for use and a vertical position for sorage and a counterbalancing mechanism which includes, a counterbalancing unit which is positioned at the side of said bed when the bed is in said vertical position and has a lever, and means rigidly mounting said counterbalancing unit, said lever extending generally horizontally and being pivotally mounted at one end about an axis parallel to the axis of the swinging movement of said bed, a gas spring positioned generally vertically with a fixed pivot at its lower end and with its upper end pivotally connected to said lever whereby said gas spring expands and contracts in accordance with the swinging movement of said lever, and means attached to said lever and to the adjacent side of said bed whereby said gas spring exerts a force upon said lever which produces a lifting moment on said bed to substantially counterbalance the weight of said bed as it swings between its horizontal and vertical positions.

11. The construction as described in any of claims 1, 2, 4, 5, 6, 7 and 10 which includes rigid means interconnecting said levers.

* * * * *